US006739053B2

(12) United States Patent
McCambridge et al.

(10) Patent No.: US 6,739,053 B2
(45) Date of Patent: May 25, 2004

(54) HAIR CLIPPING DEVICE WITH INTERNAL VACUUM

(75) Inventors: James Edward McCambridge, Polo, IL (US); Jon Thomas Freas, Rock Falls, IL (US); Jason M. Long, Morrison, IL (US); Walter Francovich, Pierrefonds (CA)

(73) Assignee: Wahl Clipper Corporation, Sterling, IL (US)

( * ) Notice: Subject to any disclaimer, the term of this patent is extended or adjusted under 35 U.S.C. 154(b) by 4 days.

(21) Appl. No.: 09/737,095

(22) Filed: Dec. 14, 2000

(65) Prior Publication Data

US 2002/0073549 A1 Jun. 20, 2002

(51) Int. Cl.[7] ..... B26B 15/00

(52) U.S. Cl. ..... 30/34.1; 30/133; 30/527; 30/216

(58) Field of Search ..... 30/133, 34.1, 527, 30/210, 216, 195; D28/52

(56) References Cited

U.S. PATENT DOCUMENTS

| | | | | |
|---|---|---|---|---|
| 1,506,139 A | | 8/1924 | Severson | |
| 1,618,713 A | | 2/1927 | Kaufmann | |
| 2,484,610 A | | 10/1949 | Cromonic | |
| 3,384,919 A | | 5/1968 | Jording et al. | 15/339 |
| 3,648,370 A | * | 3/1972 | Cercone | 30/201 |
| 3,654,699 A | * | 4/1972 | Garcia | 30/133 |
| 4,085,503 A | | 4/1978 | Beck et al. | 30/34.1 |
| 4,348,810 A | * | 9/1982 | Oda et al. | 30/200 |
| 4,581,822 A | * | 4/1986 | Fujimura | 30/201 |
| 4,776,095 A | | 10/1988 | Tsujimoto et al. | 30/201 |
| 4,843,717 A | * | 7/1989 | Crane | 30/133 |
| 4,868,984 A | * | 9/1989 | Elsherbini | 30/133 |
| 4,899,442 A | * | 2/1990 | Horii et al. | 30/133 |
| 4,985,999 A | * | 1/1991 | Iwasaki et al. | 30/133 |
| 5,012,576 A | * | 5/1991 | Johannesson | 30/133 |
| 5,075,971 A | | 12/1991 | McCambridge | |
| 5,084,973 A | * | 2/1992 | Geer | 30/133 |
| 5,084,974 A | | 2/1992 | Sukow et al. | 30/201 |
| 5,153,994 A | * | 10/1992 | Emmett | 30/133 |
| 5,325,589 A | * | 7/1994 | Kubo | 30/195 |
| 5,579,581 A | * | 12/1996 | Melton | 30/223 |
| 5,881,462 A | * | 3/1999 | Romani | 30/133 |
| 5,970,616 A | * | 10/1999 | Wahl et al. | 30/199 |
| 2002/0108255 A1 | | 8/2002 | Degregorio, Jr. | |

FOREIGN PATENT DOCUMENTS

| | | |
|---|---|---|
| BG | 833 086 | 12/1975 |
| DE | 37 35 340 A1 | 4/1989 |
| GB | 714863 | 9/1954 |

* cited by examiner

*Primary Examiner*—Boyer Ashley
*Assistant Examiner*—Thomas J Druan, Jr.
(74) *Attorney, Agent, or Firm*—Greer, Burns & Crain, Ltd.

(57) ABSTRACT

A hair clipping device includes a housing, a bladeset engageable upon the housing and including at least one stationary blade and at least one moving blade configured for reciprocal movement relative to the at least one stationary blade. The stationary blade has a first cutting edge and a second cutting edge, the at least one moving blade including a first moving edge configured for reciprocal movement relative to the first cutting edge, and a second moving edge configured for reciprocal movement relative to the second cutting edge. The housing defines a cutting location for the blades and the bladeset is rotatably engageable on the housing between a first position in which the first edges are employed, and a second position in which the second edges are employed. The housing encloses an apparatus for creating a vacuum, and defines a vacuum intake.

14 Claims, 8 Drawing Sheets

Fig. 5
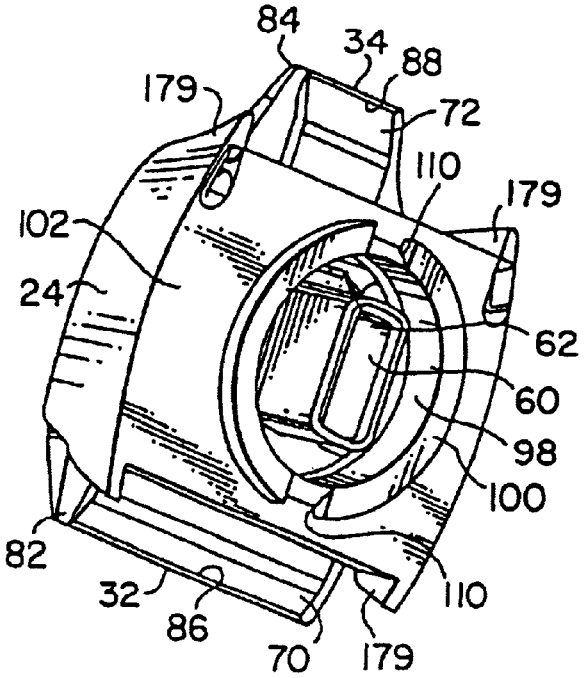
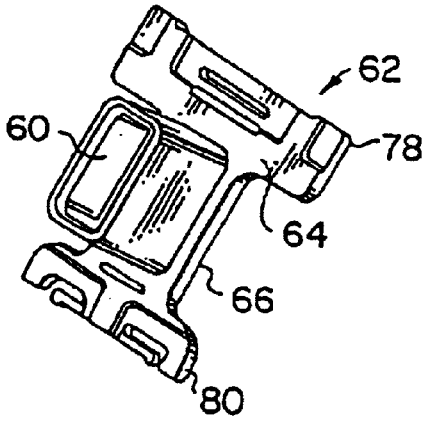
Fig. 6
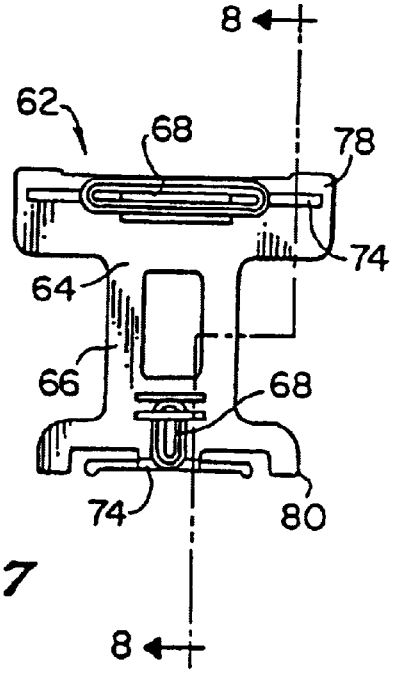
Fig. 7

HAIR CLIPPING DEVICE WITH INTERNAL VACUUM

BACKGROUND OF THE INVENTION

The present invention relates to devices for clipping hair, and more specifically to hair clipping devices designed for use in trimming facial hair such as moustaches, beards and sideburns, as well as touch up trimming or general trimming of hair anywhere on one's head or body.

A common problem to both individuals sporting facial hair such as moustaches, beards and sideburns, and professional hair stylists having such individuals as customers, is the collection of hair clippings generated in grooming and trimming such facial hair, and/or trimming of other stray hairs on or around the neck, ears, eyes or other light duty general hair trimming. Whether the trimming is accomplished with a powered trimmer or clippers, or with an ordinary scissors, the typically relatively short hair clippings have the tendency to spread over a wide area of a counter, sink or table adjacent the mirror used to facilitate the trimming, as well as upon the individual being trimmed. Clippings on one's clothing are especially unsightly. It has been found that the resulting mess from such trimming is worse when an electric trimmer is used, since the reciprocating blades have the tendency to throw the clippings over a wider area.

In an approach to solving the problem which is designed particularly for hair stylists, an electric hair clipper has been provided in which a vacuum hose is connectable to an outlet on the clipper body. This apparatus is somewhat cumbersome, requires a separate vacuum unit and is not well suited to home use.

Another attempt to address the problem of collecting hair trimmings is commonly-assigned U.S. Pat. No. 5,075,971, which discloses a cordless trimmer for delicate hairs such as those growing in or around the nose, ears and/or eyes. Since this device is compact, relatively low powered and designed for precise cutting of delicate areas, there is a perceived need for a unit with greater power and cutting capacity. Also, both cordless and AC-powered units are desired. An increase in power will generate additional clippings, and as such a more effective vacuum system is needed.

Another concern of individuals with facial hair is the ability to precisely trim around the nose, lips and ears with the same device as is used for performing the "gross" trimming. In response, some conventional electric clippers or shavers offer auxiliary pop-up trimming blades which are supplemental to the main cutting blades. However, one disadvantage of these supplemental trimming blades is that they are placed in close proximity to the main blades, and in some cases both sets of blades may cut hair, while only one set is so intended. The result is an uneven trimming job and a frustrated user. In some cases, the unintended set of blades may pull the hair or skin of the user. Further, the close proximity of the main and auxiliary blades in some cases obscures the visibility of the area to be trimmed.

Accordingly, a first object of the present invention is to provide an improved hair clipping device with accessible and visible blades for performing both gross and fine trimming.

Another object of the present invention is to provide an improved hair clipping device with an internal vacuum for easily collecting hair, and with blades for performing both gross and fine trimming wherein the device is configured so that the vacuum is effective in collecting clippings regardless of whether gross or fine trimming is performed.

Yet another object of the present invention is to provide an improved hair clipping device with blades for performing both gross and fine trimming, wherein the type of trimming can be selected while the user retains the same hand position, and wherein the cutting location is easily viewed.

Still another object of the present invention is to provide an improved hair clipping device which features a rotatable bladeset which provides a choice between fine and gross trimming, and also featuring a locking assembly to releasably secure the chassis in the selected position.

A further object of the present invention is to provide an improved hair clipping device which features a rotatable bladeset which provides a choice between fine and gross trimming, wherein when one such type of trimming is selected, the non-selected blades are kept out of the way to minimize interference with cutting or snagging by the selected blades.

A still further object of the present invention is to provide an improved hair clipping device which features a rotatable bladeset which provides a choice between fine and gross trimming, and a comb assembly, with a locking mechanism configured so that both the bladeset and the comb assembly may be released with a single button.

BRIEF SUMMARY OF THE INVENTION

The above-listed objects are met or exceeded by the present hair clipping device with rotating wide and narrow bladeset which provides both gross and fine trimming capabilities. Once the user selects a type of trimming to be performed, the non-selected blades are sufficiently isolated from the desired cutting location to prevent their obstruction or interference with the main cutting action. Another feature of the present clipping device is an internal vacuum system. In a preferred embodiment, the vacuum system is powered by the same motor which powers the clipper blades. Clippings are collected within the housing and can easily be removed for disposal. Both wide and narrow blades are provided on a pivotable chassis which is driven by a single drive member. Whichever blade is selected is disposed close enough to the vacuum intake so that clippings are collected. The selected size blade is releasably locked in place, and the comb assembly is also secured to a clipper housing. When the narrow blade is selected, it may project farther over the intake for greater accessibility to the delicate areas to be trimmed, and greater visibility of those areas. When a comb is provided, a single button releases the engagement of the comb and the position of the rotating bladeset relative to the housing.

More specifically, the present invention provides a hair clipping device including a housing, a bladeset engageable upon the housing and including at least one stationary blade and at least one moving blade configured for reciprocal movement relative to the stationary blade. The stationary blade has a first cutting edge and a second cutting edge, the at least one moving blade including a first moving edge configured for reciprocal movement relative to the first cutting edge, and a second moving edge configured for reciprocal movement relative to the second cutting edge. The housing defines a cutting location for the blades and the bladeset is rotatably engageable on the housing between a first position in which the first edges are employed, and a second position in which the second edges are employed.

In another embodiment, a hair clipping device is provided, including a housing enclosing an apparatus for creating a vacuum, and having a vacuum intake. A blade chassis is also provided and is engageable upon the housing, and has a bladeset including at least one stationary blade and at least one moving blade configured for reciprocal movement relative to the stationary blade. The stationary blade has a first cutting edge and a second cutting edge, the at least one moving blade including a first moving edge configured for reciprocal movement relative to the first cutting edge, and a second moving edge configured for reciprocal movement relative to the second cutting edge.

A cutting location is defined by the housing for the blades, and the blade chassis is rotatably engageable on the housing between a first position in which the first cutting edge and the first moving edge are disposed at the cutting location, and a second position in which the second cutting edge and the second moving edge are disposed at the cutting location. The cutting location is adjacent the vacuum intake so that hair clippings generated by the cutting action of the blades are drawn into the vacuum intake regardless of which cutting position is selected.

BRIEF DESCRIPTION OF THE SEVERAL VIEWS OF THE DRAWINGS

FIG. 5 is an inverted perspective elevational view of the blade chassis of FIG. 4;

FIG. 6 is a perspective elevational view of the cam follower of the present bladeset;

FIG. 7 is a bottom view of the cam follower of FIG. 6;

DETAILED DESCRIPTION OF THE INVENTION

Figure 1:
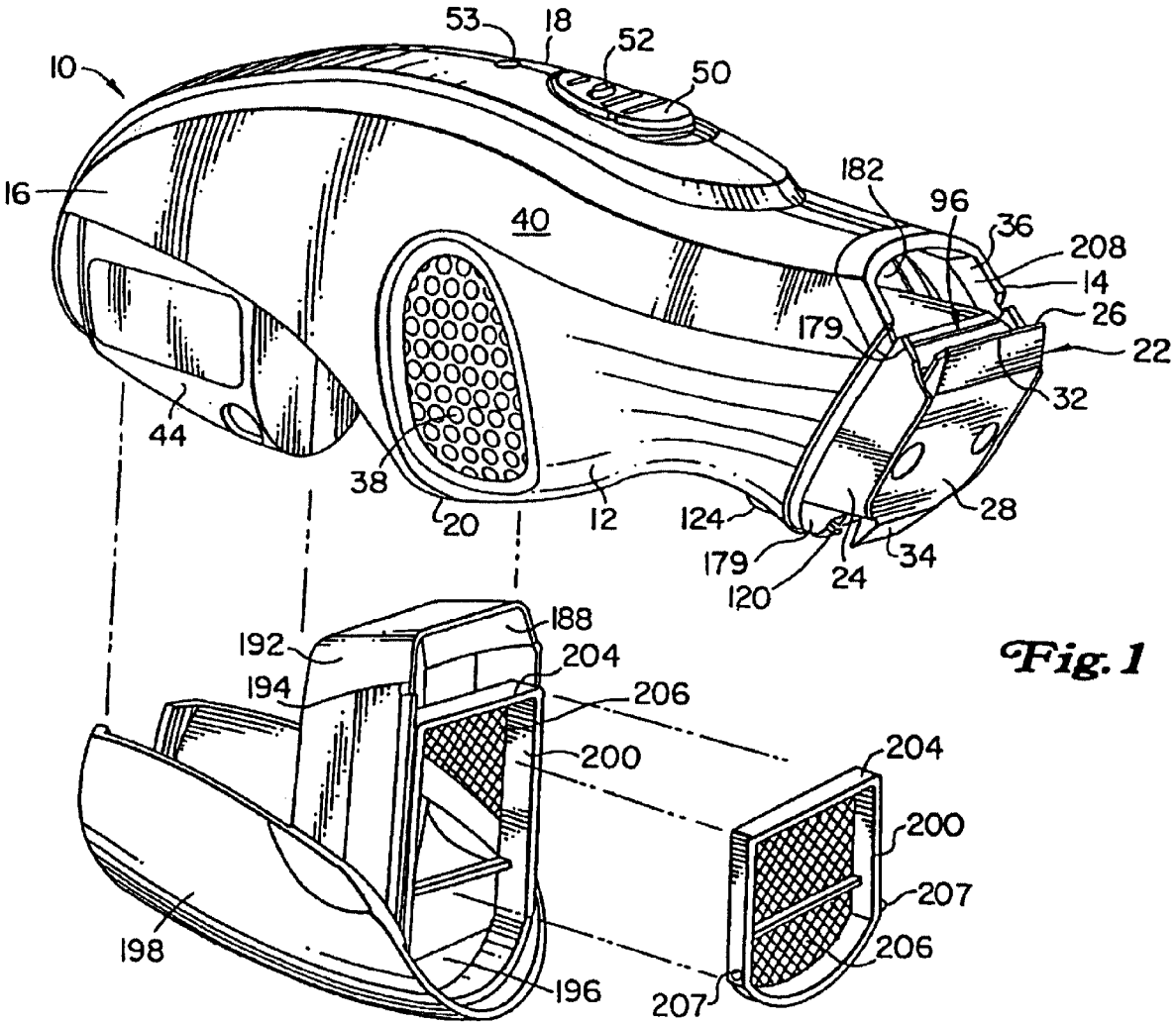
FIG. 1 is an exploded perspective elevational view of the present hair clipping device.
Figure 2:
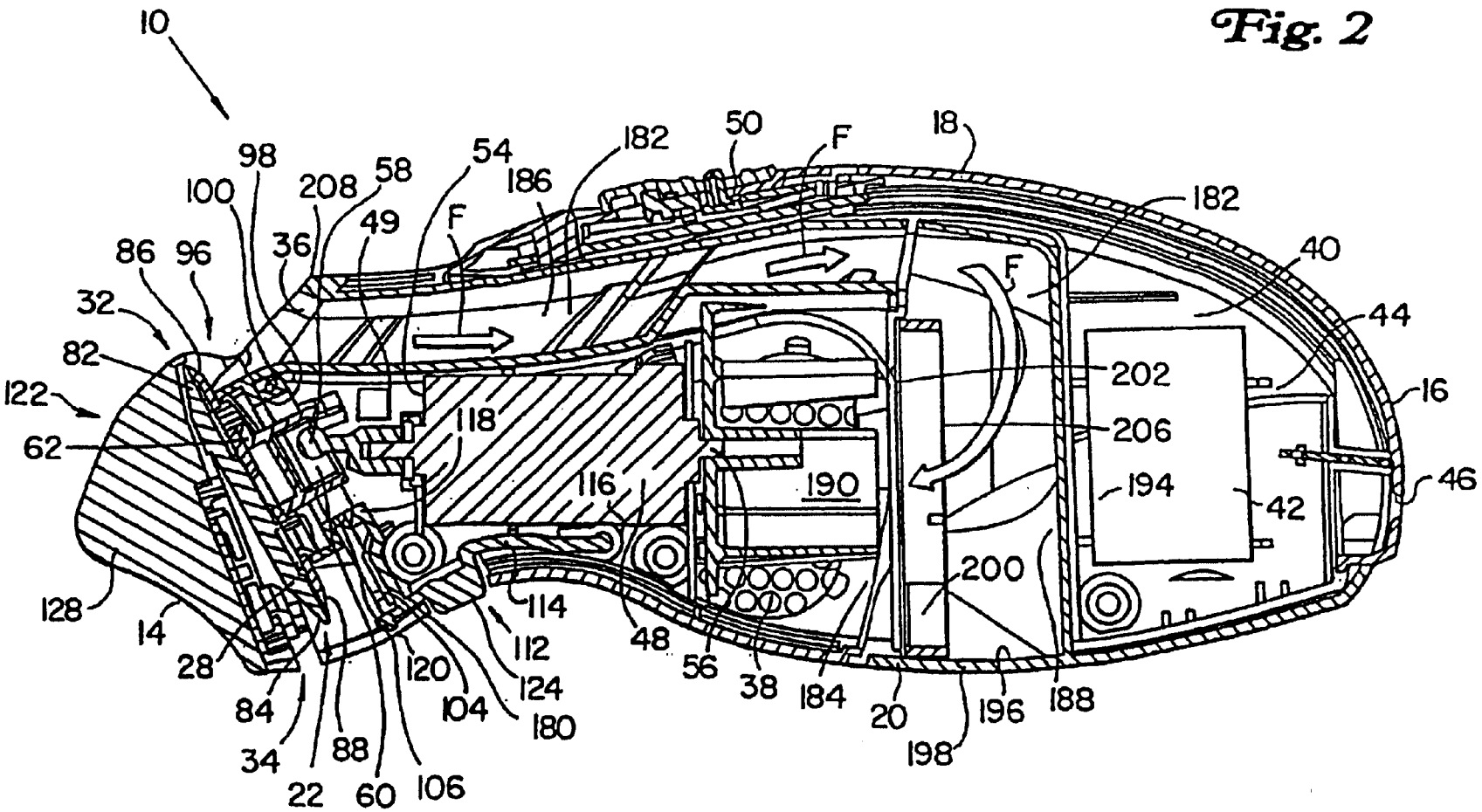
FIG. 2 is a vertical section of an assembled version of the clipping device of FIG. 1 equipped with a comb assembly.

Referring now to FIGS. 1 and 2, a hair clipping device suitable for use with the present invention is generally designated 10. It is contemplated that, while the clipper shown is generally referred to as a trimmer, the features and principles of the invention may be applied to other conventional types of electric hair cutting appliances, including clippers and shearers, and whether powered by AC line cord or batteries. The device 10 includes a housing 12 having a front or cutting end 14, and an opposite rear or power end 16. For purposes of the present application, the device 10 is held in a user's hand in the orientation shown in FIG. 1, and as such a top of the device 10 is designated 18, and a bottom is designated 20.

The cutting end 14 features a blade assembly 22, which includes a blade chassis 24 to which is attached a bladeset 26 having at least one stationary blade 28 and at least one moving blade 30. In the present application "chassis" refers to any sort of platform or support to which blades can be mounted, and which is movable relative to the housing 12. While a preferred chassis 24 is a generally planar platform with generally vertically extending walls, other configurations of blade supports are contemplated, such as bars, disks, turntables, etc. Also, one piece or multiple piece stationary and moving blades are contemplated. As is well known in the hair clipping art, the cutting action is obtained by the reciprocal linear movement of the moving blade 30 relative to the stationary blade 28. In a preferred embodiment, as will be described below, one of the features of the present invention is that the bladeset 26, and specifically the blade chassis 24 is rotatable relative to the housing 12, to provide the user with the capability of selectively performing either "gross" or "fine" trimming with one of a first or relatively wide blade edge 32 and a second or narrow blade edge 34. It is contemplated that the first and second edges may alternatively be narrow and wide, or both may be narrow or both wide, depending on the application.

Another feature of the device 10 is an internal vacuum system, which is evident from a vacuum intake 36 formed at the cutting end 14 of the housing 12, and at least one and preferably two exhaust outlets 38 shown in sides 40 of the housing 12. At the power end 16, a battery 42 (either rechargeable or non-rechargeable) may be located in a battery compartment 44 (FIG. 2), and/or a receptacle 46 may be provided for an AC adaptor (not shown), as is well known in the art. It is also contemplated that the device 10 be provided with an AC line power cord, as is well known, to have the capability of operating either from wall current or from battery power.

Referring now to FIG. 2, the power source of the device 10 is an electric motor 48. In a preferred embodiment, the device 10 is provided with a magnet 49 as disclosed in German Patent No. DE 19617448 A1, incorporated by reference, for placing a biasing force on a shaft of the motor to reduce noise and increase the life of the motor 48. The motor 48 is controlled by a switch 50. In a preferred embodiment, the switch 50 features a lockout button 52 which prevents operation of the motor until the button is depressed and the switch actuated. This prevents the device 10 from becoming accidentally turned on and running in a drawer, or a suitcase while traveling and discharging the battery 42. An LED 53 preferably provides a visual indication of when the unit 10 is plugged into a transformer for recharging the battery 42, when a rechargable battery is included. The motor 48 has a drive end 54 and an opposite fan end 56. At the drive end 54, an eccentric drive member 58 is configured to matingly engage a follower chamber 60 defined by and extending from a cam follower 62. As is well known in the clipper art, cam followers are used to translate the eccentric rotary motion of the drive member 58 into linear reciprocating movement of a moving blade relative to a stationary blade, which creates a scissors-like cutting action. Commonly-assigned U.S. Pat. No. 5,579,581 discloses a conventional cam follower arrangement, and is incorporated by reference.

Figure 16:
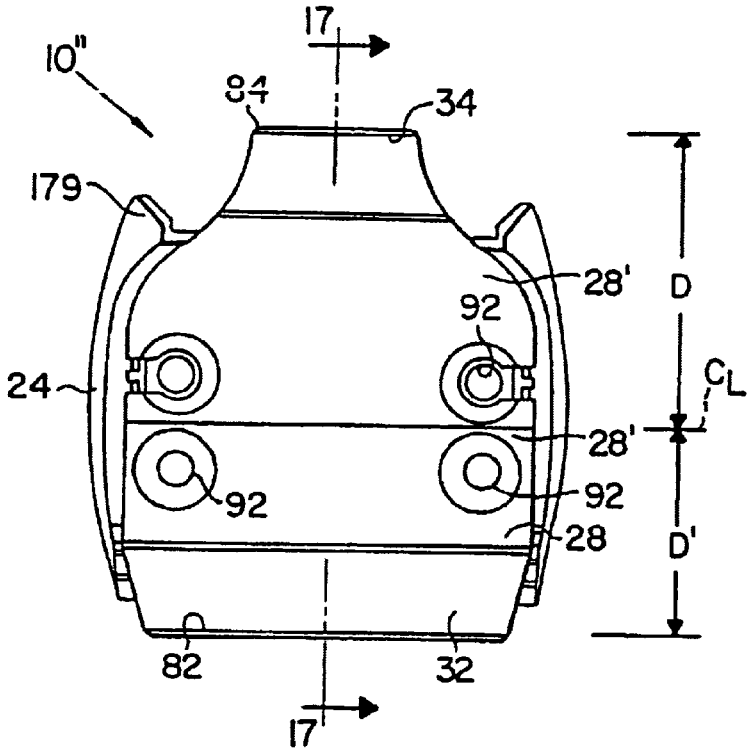
FIG. 16 is a fragmentary end view of an alternate embodiment of the clipper of FIG. 3.
Figure 17:
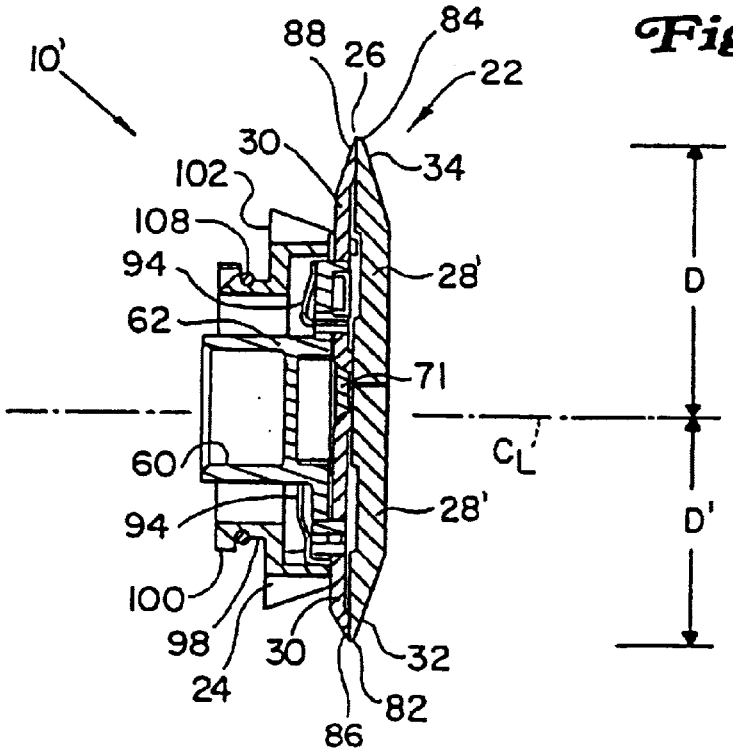
FIG. 17 is a cross-section taken along the line 17–17 of FIG. 16 and in the direction indicated generally.

Referring now to FIGS. 4–8B and 16–17, the cam follower 62 is generally "H"-shaped when viewed from above and has a generally planar blade contact member 64, from which the follower chamber 60 projects normally, and a blade contact surface 66 opposite the side from which the follower chamber 60 projects. The blade contact surface 66 includes locating lugs 68 for engaging at least one and preferably two moving blades 70, 72. An embodiment with one moving blade is generally designated 10' and is depicted in FIG. 17. In that embodiment, which otherwise corresponds to, and is contemplated as being interchangeable with, the embodiment of FIG. 4, the single moving blade is referred to as 71. To account for manufacturing and/or alignment differences between the two moving blades 70, 72, at least one and preferably several leveling ribs 74 are provided on the blade contact surface 66. When multiple ribs are provided at a specified end of the cam follower 62, it is important that they be positioned along a common line. In a preferred embodiment, the ribs 74 are elongate for engaging the surface of the corresponding moving blade. An important function of the ribs 74 is engaging the moving blades 70, 72 to take up space caused by differences in manufacturing tolerances of the moving blades and exerting uniform force in biasing each moving blade against at least one stationary blade 76. While the number of ribs 74 may vary to suit the application, where two moving blades 70, 72 are employed, it is contemplated that two ribs are provided for each moving blade, with a total of four ribs for the device 10.

It will also be seen that the cam follower 62 is not symmetrical, but has a wide end 78 and a narrow end 80. This is because, in a preferred embodiment, the device 10 is provided with the wide and narrow cutting edges 32, 34. However, it is contemplated that the cam follower 62 could alternately have ends of generally equal width, when the cutting edges 32, 34 are of generally equal width. Fundamentally, the cam follower is designed to exert uniform tension across as much of the blade as possible. Accordingly, the at least one stationary blade 28 has a first or wide cutting edge 82 and a second or narrow cutting edge 84. Likewise, the at least one and preferably two moving blades 70, 72 include a first or wide moving edge 86 configured for reciprocal movement relative to the first cutting edge 82, and a second or narrow moving edge 88 configured for reciprocal movement relative to the second cutting edge 84.

Figure 4:
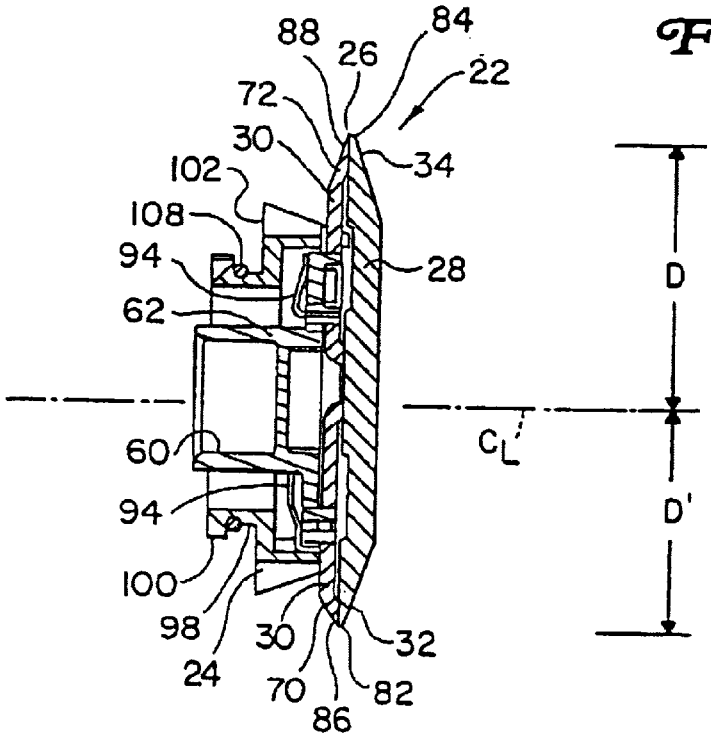
FIG. 4 is a cross-section taken along the line 4—4 of FIG. 3 and in the direction indicated generally.

As is seen in FIGS. 2 and 4, the moving blades 70, 72 are disposed in the bladeset 26 so that the respective cutting edges 86, 88 are in back-to-back relationship to each other. In this context, "back-to-back" refers to a preferred approximately 180° disposition of one moving blade relative to the other. Other relative angular dispositions of the moving blades are contemplated depending on the application. While two separate moving blades 70, 72 are preferred, it also contemplated, as shown in FIG. 17, that one unitary moving blade could also be provided, as indicated by the blade 71.

As indicated above, in a preferred embodiment, the device 10 is provided with the wide cutting edge 32 and the narrow cutting edge 34. This is for allowing the user to be able to perform "gross" trimming of a beard, moustache, sideburns or the like with a wide edge, as well as fine edge or detail trimming with a relatively narrower edge. In the context of this application, the terms "blade" or "cutting edge" will refer to conventional types of clipper blades with a plurality of spaced teeth, as are well known in the art. The cutting action of the clipping device is obtained by linear reciprocal movement of one set of teeth relative to the other. The size and type of the first and second edges 32, 34 may be changed as desired, both blades might be the same size and type, or reversed, depending on the application. It is also contemplated that the pitch or spacing of teeth of the respective blades may also vary to suit the application, as is known in the art. As indicated above, while a single stationary blade 28 is preferred, it is also contemplated that dual or other multiple arrangements of stationary blades could be employed. FIG. 16 depicts an alternate embodiment designated 10" in which multiple stationary blades 28' are provided. Additional mounting holes 92 are provided as needed. In other respects, the embodiment of FIG. 16 corresponds to, and is contemplated as being interchangeable with that of FIG. 3.

Figure 8:
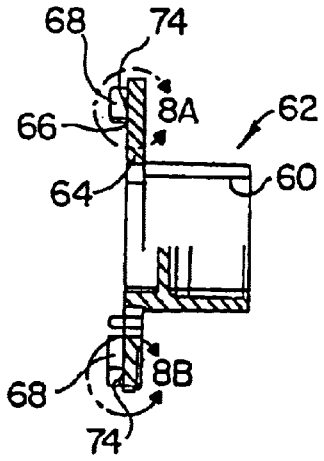
FIG. 8 is a cross-section taken along the line 8—8 of FIG. 7.
Figure 8A:
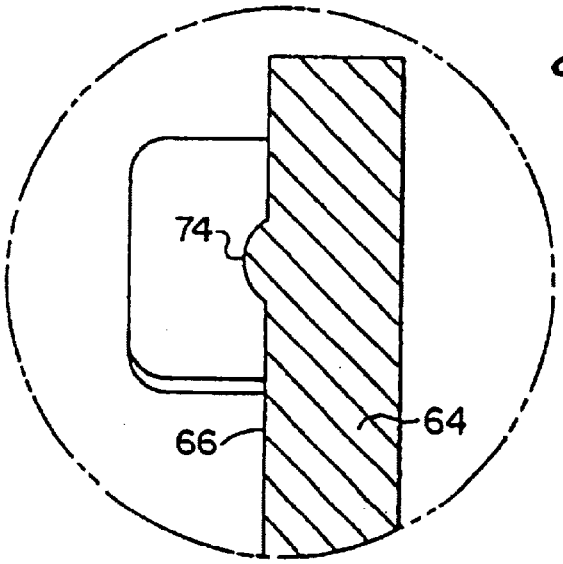
FIG. 8A is a fragmentary enlargement of FIG. 8.
Figure 8B:
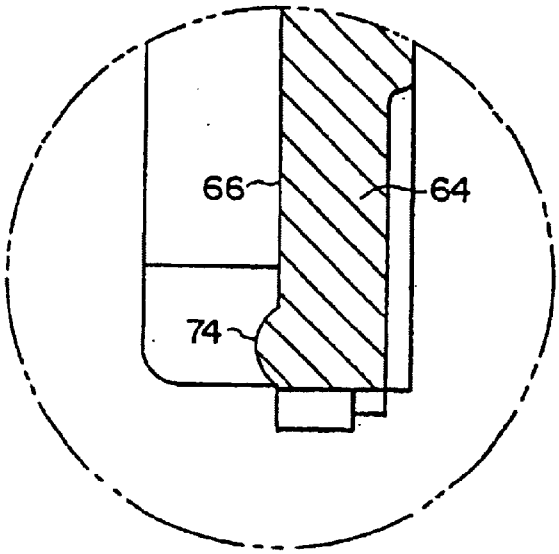
FIG. 8B is a fragmentary enlargement of FIG. 8.

Accordingly, the cam follower 62 is preferably provided with a plurality of the locating lugs 68 (best seen in FIGS. 8A and 8B) for engaging corresponding slots (not shown) or other formations on the corresponding moving blades 70, 72. In this way, reciprocal linear movement of the cam follower 62 will be transmitted to the moving blades 70, 72 to effect the desired cutting action. Also, as is customary, a spring 94 (best seen in FIG. 4) or other type of biasing element is provided to bias the cam follower 62 and the moving blades 70, 72 into biased sliding engagement with the stationary blade 28.

Referring now to FIGS. 2–5, another feature of the present device 10 is that the bladeset 26 is rotatably engaged upon the housing 12 through mounting to the blade chassis 24, which in turn is rotatably engageable on the housing. The blade chassis 24 serves as a housing for the bladeset 26 and is rotatably engageable upon the housing 12 at least between a first position, in which the first cutting edge 32, including the edges 82, 86 are disposed at a cutting location, and a second position in which the second cutting edge 34, including the edges 84, 88 are disposed at the cutting location. In this context, the cutting location is designated 96, and refers to a position in close operational proximity with the vacuum intake 36, so that hair clippings generated by the trimming action of the bladeset 26 will be drawn into the vacuum intake.

Figure 3:
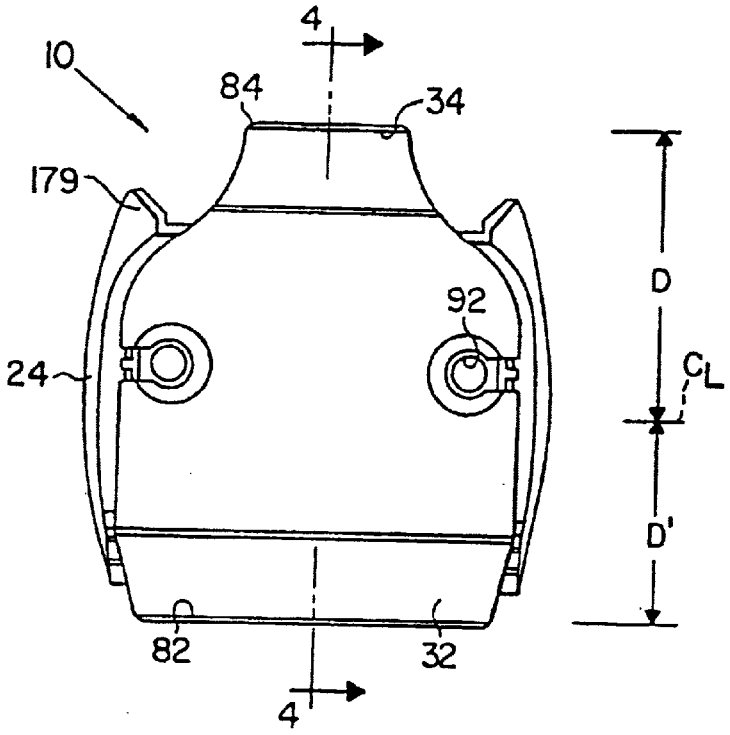
FIG. 3 is a fragmentary end view of the clipper of FIG. 1, showing the bladeset and blade chassis in a rotated position.

A related advantage of the present device 10 is that the housing 12 is configured so that the user may maintain a single gripping position when the bladeset 26 is in the cutting location 96, regardless of whether the blade chassis 24 is in the first position or the second position. Referring now to FIGS. 3 and 4, to improve the accessability of the device to trim hair in delicate areas, i.e., around the mouth, nose, ears and/or eyes, and also to improve the visibility of the cutting location 96, it will be seen that the bladeset 26 is configured so that the narrow cutting edge 84 and the corresponding narrow moving edge 88 are displaced a distance D from a centerline CL of the follower chamber 60, which is also the axis of rotation of the drive member 58. This distance D is greater than the corresponding distance D' of the displacement of the wider cutting edge 82 and the wider moving edge 86. Thus, the narrow edges or blades 34, 84, 88 extend farther over the vacuum intake 36 than the wide cutting edges or blades 32, 82, 86. The vacuum intake 36 and the vacuum apparatus of the present device 10 are sufficient to collect many of the hair clippings generated by the bladeset 26 regardless of whether the narrow blade edge 34 or the wide blade edge 32 is used. Naturally, some clippings may still escape the vacuum intake 36. Nevertheless, the additional extension of the narrow edges 84, 88 increases the accessability of the blade edge 24 to delicate areas and also increases the visibility of the cutting location 96 for the user in that position. In the event that two wide edges are provided to the bladeset 26, one of the edges would not be dimensioned to extend farther over the exhaust intake 36.

Another important feature of the present device 10 is that only one of the cutting edges 32, 34 is in operational proximity to the vacuum intake 36 at a time. Note also that the cam follower 62 is configured to simultaneously reciprocally move at least one and preferably both of the moving blades 70, 72 relative to the stationary blade 28, regardless of whether the bladeset 26 is in the first position or the second position. Even while simultaneously moving in a cutting action, the non-selected or unused blades are kept sufficiently remote from the selected blades at the cutting location 96 that they do not interfere with the cutting or trimming operation. Also, any pulling of the user's skin is also avoided. To this end, in a preferred embodiment, the unused blades (not at the cutting location 96) are disposed at least approximately 90° and preferably approximately 180° away from the blades at the cutting location. Other amounts of displacement are contemplated depending on the application.

Referring to FIGS. 2, 4 and 5 to achieve the rotatable engagement with the housing 12, the blade chassis 24 has a depending, generally cylindrical collar 98 with a radially extending flange 100. The collar 98 spaces the flange 100 away from a bottom surface 102 of the chassis 24.

At the cutting end 14 of the housing 12, an end wall 104 has an opening 106 dimensioned to rotatably accommodate the collar 98, and the flange 100 provides a retaining function on the inside of the end wall. As is typical in the clipper art, the housing 12 is provided in two vertically symmetrical halves. Assembly is achieved by loading one half with components, then placing the other half on top of the assembled half and securing the two halves together. In this case, the opening 106 is defined by the two halves, and is closed around the collar 98 upon assembly. In a preferred embodiment, an O-ring 108 (best seen in FIG. 5) is inserted between the end wall 104 and the flange 100 to provide a higher quality feel of the rotation action, and to prevent unwanted movement.

The flange 100 is provided with at least one and preferably two notches 110, (best seen in FIG. 5) which are preferably disposed approximately 180° apart from each other. These notches 110 are used to retain the blade chassis 24 in a selected position relative to the cutting location 96. A locking mechanism generally designated 112 is provided which is configured for releasably securing the bladeset 26, and specifically the blade chassis 24 in a selected one of the first and second positions at the cutting location 96.

In a preferred embodiment, the locking mechanism takes the form of a locking member 114 located within the housing 12 and configured to be biased toward a closed position. The biasing force is preferably provided by mounting the plastic locking member 114 in the housing 12 to have an inherent spring force. The locking member 114 is retained within the housing 12 at a socket-like point 116 and has a first lug 118 for engaging the blade chassis and a second lug 120 for engaging a comb assembly 122, described in more detail below. In addition, the locking member 114 has an actuator button 124 for overcoming the inherent biasing force and for releasing the lug 118 from biasing engagement with a selected one of the notches 110. If present, the comb assembly 122 is released at this time as well. Until the button 124 is depressed, the lug 118 will engage the notch 110 and secure the blade chassis 24 in a selected cutting position and will prevent unwanted rotation.

Referring now to FIGS. 2 and 9–13, the comb assembly 122 will be described in greater detail. As is known in the art, replaceable attachment combs are known for hair clipping devices, as exemplified in commonly assigned U.S. Pat. No. 6,079,013, incorporated by reference, and are used for assisting the user in obtaining hair cut to a uniform length.

Figure 12:
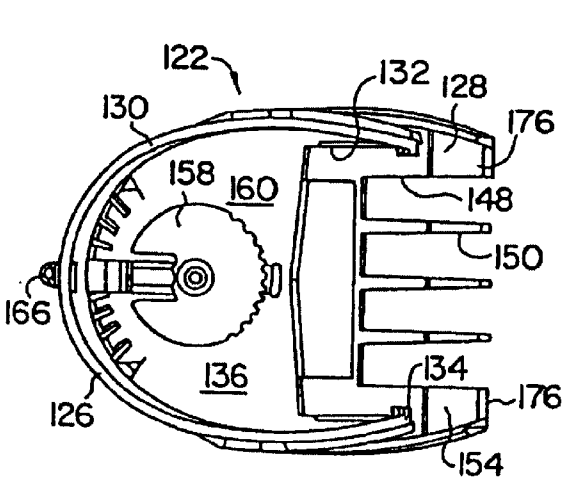
FIG. 12 is an underside view of the comb assembly of FIG. 9 shown in the extended position.
Figure 13:
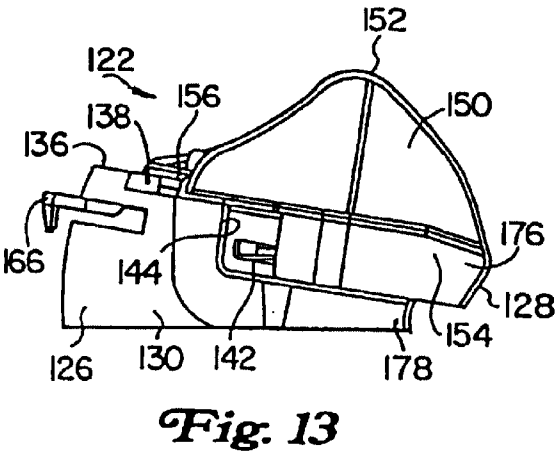
FIG. 13 is a side elevational view of the comb assembly of FIG. 12.

In the present device 10, the comb assembly 122 is attachable to the housing 12, and includes a comb base 126 and a comb member 128 slidably engaged on the base. One of the features of the present comb assembly 122 is that the comb member 128 is selectively and slidably adjustable relative to the comb base 126 between a retracted position (FIGS. 9–11) and an extended position (FIGS. 12–13). For the purposes of this invention, while it is preferred that the comb assembly 122 include two main components 126, 128, it is contemplated that an equivalent comb could be a single piece unit. For example, a single piece comb could be adjustable between an extended and a retracted position relative to the housing 12. Thus, the terms "comb" and "comb assembly" will refer to both single component and multiple component combs.

More specifically, the comb base 126 has a cowl 130 which is generally "C"-shaped when viewed from above and defines a blade opening 132 between spaced ends 134 of the cowl. The cowl 130 is substantially enclosed at its upper end by an upper panel 136. Also, the comb base 126 is dimensioned to substantially enclose the blade chassis 24, with the blade opening 132 being the portion not enclosing the chassis.

The upper panel 136 has at least one and preferably two guide ribs 138 for defining a sliding path for the comb member 128. In addition, a pair of outer slide tracks 142 are formed along side edges of the comb base 126 where the upper panel 136 meets an upper edge of the cowl 130. The cowl 130 also has a stop 144 at one end of the slide tracks 142 to prevent excessive retraction of the comb member 128.

A base panel 146 is the central portion of the comb member 128, and defines a generally rectangular blade aperture 148 which is in communication with the blade opening 132 of the cowl 130. Projecting from the base panel 146 are a plurality of spaced parallel fins or ribs 150 having a generally triangular shape, with a radiused apex 152. Lateral edges of the base panel 146 form depending hood-like skirts 154 which slidably engage the outer slide tracks 142. An underside of the base panel 146 also has at least one rail 156 for slidably engaging the guide ribs 138 on the comb base 126.

An adjustment mechanism is provided to control the amount of extension of the comb member 128 relative to the comb base 126 between an extended and a retracted position, and also to maintain that extension adjustment even if the comb assembly 122 is removed from the device 10. This adjustment mechanism includes a rotatable actuator 158 mounted at an axial pivot point to an underside 160 of the upper panel 136 of the comb base 126 and having an eccentrically disposed lug 162. The actuator 158 is preferably a flat circular disk, with a partially serrated outer edge 164. A handle 166 projects radially from the disk, and is engaged in a slot 168 in the cowl 130.

The eccentric lug 162 is slidably engaged in an arcuate slot 170 (shown hidden) in the upper panel 136 of the comb base 126. In addition, the lug 162 is of sufficient length to also project through an aperture 172 in the base panel 146 of the comb member 128. Thus, linear reciprocal movement of the handle 166 in the slot 168 causes rotation of the actuator 158. Simultaneously, rotation of the actuator 158 causes the lug 162 to move in the arcuate slot 170, which also, through the engagement in the aperture 172, causes the comb member 128 to linearly travel along the guide ribs 138 and the slide tracks 142. It is contemplated that the present adjustment mechanism could also be configured with the actuator 158 and the lug 162 on the comb member 128 and aperture 172 on the comb base 126.

To maintain the selected extension of the comb member 128 relative to the comb base 126, a depending tab 174 is provided on the underside of the upper panel 136 and is constructed and arranged for ratcheting engagement with the serrations on the edge 164 of the actuator 158. Thus, unwanted movement of the comb member 128 is prevented, and the user is provided with a tactile and potentially audible indication of the amount of extension movement.

Another feature of the device 10, and particularly the comb assembly 122, is that it provides a deflection function, in that it facilitates the entry of hair clippings into the vacuum intake 36. The main deflective surfaces are the hooded skirts 154 preferably provided on the side edges of the comb member 128, but also contemplated as being provided on a single piece comb. More specifically, free ends 176 of the skirts which are adjacent the bladeset 26 are also adjacent the vacuum intake 36. As such, they receive and deflect clippings which are thrown laterally by the action of the bladeset 26, into the intake 36. This deflection is enhanced by projections 178 on the ends 134 of the cowl 130, which are in general vertical alignment with the corresponding skirts 154 to form a more extensive deflective barrier against the escape of stray clippings.

Figure 10:
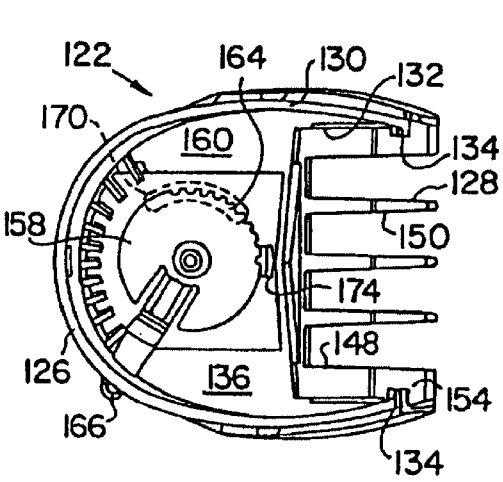
FIG. 10 is an underside view of the comb assembly of FIG. 9.
Figure 9:
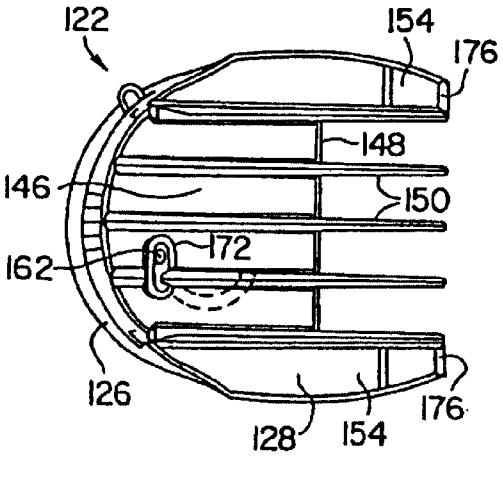
FIG. 9 is an overhead view of the present comb assembly shown in a retracted position.
Figure 11:
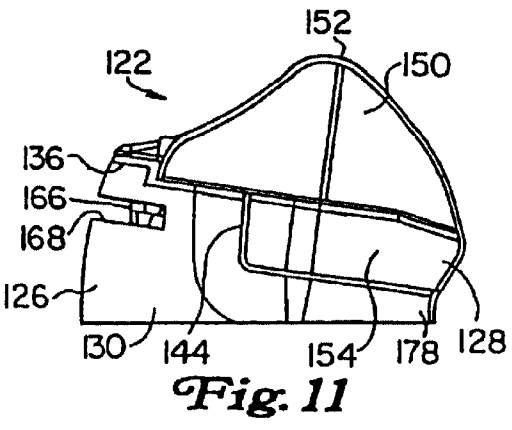
FIG. 11 is a side elevational view of the comb assembly of FIG. 9.

Referring now to FIGS. 10–13, as the comb assembly 122 is extended from the retracted position of FIGS. 10 and 11 to the extended position of FIGS. 12 and 13, it will be seen that the deflective action of the comb assembly becomes more comprehensive, in that the amount of deflective area increases. Specifically, the hooded skirts 154 progress farther over the vacuum intake 36, and provide increased deflective capability. On the blade chassis 24, generally triangular extensions 179 which project toward the vacuum intake 36 assist in the deflection action.

Referring now to FIG. 2, the locking member 114 is also used for retaining the comb assembly 122 upon the housing 12. In fact, another feature of the present device 10 is that the locking member also has the lug 120, which engages a slot 180 on the cowl 130. The engagement of the lug 120 in the slot 180 retains the cowl, and the comb assembly 122 in general, upon the housing 12. By depressing the button 124, the lug 120 is disengaged, and the comb assembly 122 can be removed. Thus, the button 124 serves two functions simultaneously when a comb assembly 122 is provided. Also, to improve visibility, and accessibility to sensitive areas, it is preferred that the comb assembly 122 is engageable on the housing 12 only when the blade chassis 24 is in the first position, for cutting by the relatively wide blade edge 32. Thus, to use the narrow blade edge 34, the comb assembly 122 should be removed.

Referring now to FIGS. 1, 2 and 14–15, another feature of the present device 10 is that it creates a vacuum for the collection of cut hair clippings. In addition to the vacuum intake 36, the housing 12 defines a vacuum passageway 182 connecting the intake to a fan chamber 184. The passageway 182 is generally rectangular in cross-section and in a preferred embodiment generally follows the ergonomically-shaped contour of the housing 12. While not completely airtight, the passageway 182 is isolated from the motor 48, the bladeset 26 and the battery compartment 44 of the device 10. A first portion 186 of the passageway 182 is generally parallel to a longitudinal axis of the housing 12. However, a second portion 188 of the passageway 182 is located between the battery compartment 44 and the fan chamber 184, and is oriented at an approximate 90° angle to the first portion 186. Both portions 186, 188 are in fluid communication with each other, and also with the fan chamber 184.

A fan 190 is rotatably disposed in the fan chamber 184, and has an axis of rotation defined by the fan end 56 of the motor 48 to which the fan is attached. While, in a preferred embodiment, the fan 190 is powered by the same motor 48 which powers the bladeset 26, it will be appreciated that a separate fan motor could be provided. It is also contemplated that other fan drive mechanisms may be alternately provided, such as indirect gear or pulley mechanisms. The fan 190 is configured so that, upon rotation, it draws air into the vacuum intake 36, down the first portion 186, into the second portion 188 and into the fan chamber 184. Hair clippings entrained in the airflow will tend to fall out of the flow as the air makes a 180° turn in directional flow from the first portion 186, which is generally parallel to the axis of rotation of the fan, to the fan chamber 184. This flow path is indicated by the arrows F.

Another feature of the device 10 is that the second portion 188 of the vacuum passageway 182 is removable from the housing 12 as a clipping trap (best seen in FIG. 1). More specifically, the second portion 188 is formed as an open tray or box, with four walls 192 and a floor 194. The open end of the box is in communication with the first portion 186 of the passageway 182, and also with the fan chamber 184. Due to the 180° turn of air flow, clippings are deposited from the air flow into the second portion 188. A lower end 196 of the portion 188 is secured to, or is integrally molded with, a segment 198 of the housing 12 which serves as a handle for removing the clippings when needed. The second portion 188 is removable in a perpendicular direction relative to the flow of air in the first portion 186.

To prevent clippings from migrating into the fan chamber and fouling the fan 190 and/or the motor 48, a filter 200, shown in FIG. 1 in place and exploded away, is disposed at an entrance 202 to the fan chamber 184. The filter 200 includes a frame 204 dimensioned to fit within the second portion 188 to be removable from the housing therewith, and a sheet of filter cloth 206 secured to the frame. The mesh size of the cloth 206 is fine enough to prevent the entry of clippings, but large enough to permit air flow. To prevent loss of the filter 200, the frame 204 is preferably provided with at least one and preferably two pivot projections 207, one located on each side. These projections 207 engage corresponding recesses (not shown) on the walls 192 to allow the frame 204 to pivot relative to the second portion 188. This allows the portion 188 to be emptied and the filter cloth 206 cleaned, without removing the filter from the device 10. However, the frame 204 is also removable from the second portion 188.

A function of the frame 204 is to axially displace the filter cloth 206 away from the entrance 202 to the fan chamber 184. This displacement, along with the substantially greater area of the filter cloth 206 relative to the entrance diameter, reduces the probability of a large number of clippings becoming caught in the filter and bogging down the motor 48. In operation, the frame 204 snaps into the second portion 188 of the vacuum passageway 182.

Figure 15:
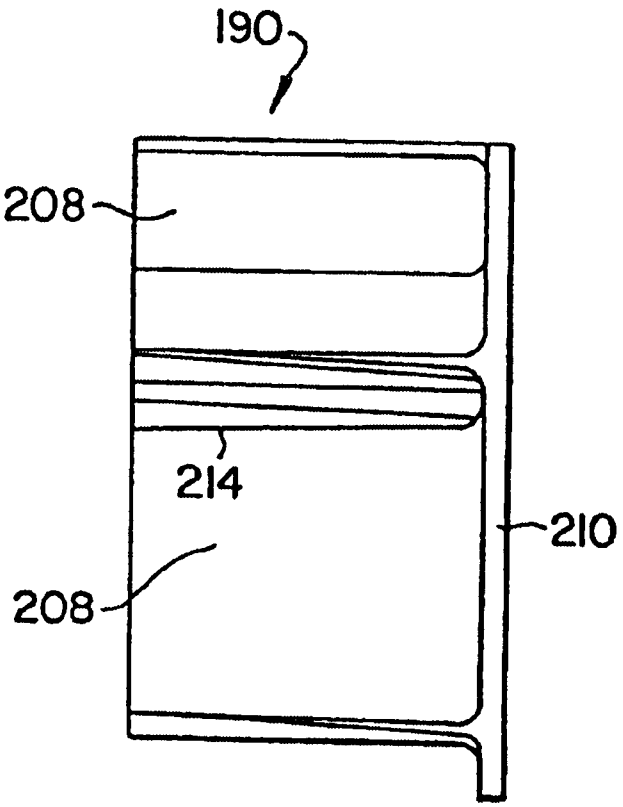
FIG. 15 is a side elevational view of the fan of FIG. 14.
Figure 14:
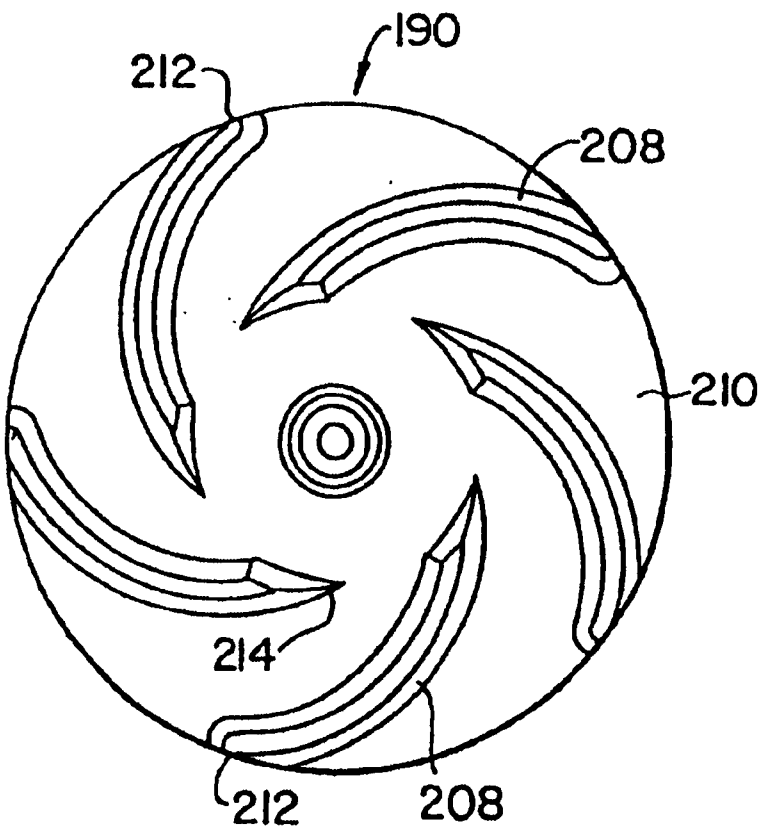
FIG. 14 is a front view of the fan of the present clipping device.

Referring now to FIGS. 14 and 15, it has been found that the fan 190 needs to have at least certain minimum performance characteristics to properly draw clippings into the housing. One characteristic is that the fan must draw sufficient vacuum when operating in the range of between 2,500 and 9,000 RPM, the range contemplated in conventional electric hair clipping devices. In a preferred embodiment, the desired motor speed is approximately 7,000 RPM, and is achieved with a 2.5 Amp, 1.2 Volt motor 48. It has been found that at speeds below 2,500 RPM, insufficient vacuum is obtained, and at speeds above 9,000 RPM, excessive power use and motor wear is encountered. In contrast, the fans of conventional vacuum appliances operate at much higher speeds, in the range of 13,000–15,000 RPM or more. Another design factor is that sufficient air movement must be generated in the vacuum passageway 182 to create vacuum pressure and to move the clippings into the second portion 188 of the passageway. In other words, for a specified diameter of the fan 190, the goal is to maximize water lift and also maximize the air flow in CFM (cubic feet per minute). Low air flow will not overcome the mechanical advantage of thrown hair clippings, and will not draw the clippings into the intake 36.

The diameter of the fan 190 is determined by the size of the fan chamber 184. The fan 190 should extend almost to the wall of the entrance 202 and still rotate freely. In a preferred embodiment, the diameter of the fan is approximately 1.5 inches, actually 1.42 inches, the fan, operating at 7,000 RPM, and generates at least 6 CFM of air flow at 0.7 inches of water lift. Also, it has been found that the fan as sized above works well when the entrance 202 to the fan chamber 184 has a diameter of approximately 0.700 inches. These are minimum desired values for the performance of the fan 190 as provided. It will be appreciated that other fan diameters will generate different requirements to create effective vacuums. It is also preferred that the cross-sectional area of the vacuum passageway 182 is approximately the same as the diameter of the entrance 202 to the vacuum chamber 184.

In a preferred embodiment, the fan 190 includes five arcuate blades 208 spaced upon, and secured to, a circular base 210. Rear edges 212 of each blade 208 reach the outer diameter of the base. Front edges 214 of each blade 208 are pointed. The number and configuration of the blades may change to suit the application.

In operation, once the motor 48 is turned on, the fan 190 begins to rotate, drawing air in through the intake 36, down the vacuum passageway 182, into the fan chamber 184 and out the exhaust outlets 38. Once hair clipping begins, the airflow created by the fan 190 is sufficient to draw clippings into the passageway 182. As indicated above, a feature of the present invention is that the comb assembly 122 and the blade chassis 24 are configured to assist the deflection of hair clippings into the passageway 182. When the device 10 is oriented so that the bladeset 26 is disposed vertically above the vacuum intake 36, the collection of clippings will be enhanced by gravity. The use of the device 10 in the position shown in FIG. 1 will increase the In addition, as seen in FIG. 1, the intake 36 itself is configured to aid in this deflection, or at least facilitate the collection of hair clippings. In a preferred embodiment, the intake 36 has flared end walls 208 which are generally aligned with the triangular extensions 179 on the blade chassis 24, and also are adjacent the ends 176 of the hooded skirts 154.

Another feature of this configuration for the vacuum intake 36, is that it can be used to clean clippings from the surface of the counter or sink where, or above which, the trimming occurs. The user merely positions the device 10 with the intake 36 in close proximity to the surface to be cleaned. Still another feature of the configuration of the vacuum intake 36 and the cutting end 14 in general, is that it is configured so that if placed against the user's cheek or other skin surface, the a vacuum seal will not result. The proximity of the blades 70, 72 to the intake 36, and the triangular extension 179 of the blade chassis 24 assist in this function.

Once the motor 48 is turned on, not only does the fan 190 begin to rotate, but the bladeset 26 also begins to reciprocate, regardless of the position that the blade chassis 24 is fixed to relative to the housing 12. Gross trimming is accomplished with the wide blade edge 32 in the cutting location 96, with or without the use of the comb assembly 122. When the comb assembly 122 is in place, the amount of extension of the comb member 128 relative to the comb base 126 is determined by the position of the handle 166 in the slot 168. Additional deflection of clippings into the intake 36 is accomplished as the comb member 128 is extended further.

As clippings are generated, they are collected in the second portion 188 of the vacuum passageway 182. At the completion of trimming, the portion 188 may be removed from the housing 12, with the filter 200, to dispose of the clippings. If the user desires to perform some fine or detail trimming, the button 124 is depressed, enabling the removal of the comb assembly 122, and also the rotation of the blade chassis 24, until the narrow edge 34 is in the cutting location 96. The button 124 is then released, allowing for engagement between the lug 118 in the corresponding notch 110. Trimming on a fine level is then performed with the narrow edge 34, which projects farther over the vacuum intake 36 for greater visibility and accessibility to trimmable areas.

Any clean-up of the surrounding area, or of the user's clothes can be accomplished with the device 10 by orienting the vacuum intake 36 near the area to be cleaned. The collected clippings can then be removed by sliding out the second portion 188 of the vacuum passageway, as seen in FIG. 1, at which time the filter 200 can also be cleaned.

While a particular embodiment of the hair clipping device with rotating bladeset having multiple cutting edges of the invention has been shown and described, it will be appreciated by those skilled in the art that changes and modifications may be made thereto without departing from the invention in its broader aspects and as set forth in the following claims.

What is claimed is:

1. A hair clipping device, comprising:

a housing defining a vacuum intake, a fan chamber and a vacuum passageway defining fluid communication between said vacuum intake and said fan chamber, said fan chamber having an inlet;

a fan rotatably disposed in said fan chamber and having an axis of rotation;

said vacuum passageway having a first portion being generally parallel to said axis of rotation and configured so that air is drawn into said inlet in a first direction, and enters said fan chamber in a substantially opposite direction;

said vacuum passageway including a second portion extending generally perpendicular to said first portion, said second portion being removable from said housing and configured as a clipping trap for retaining collected clippings upon removal of said second portion from said housing;

a filter disposed in said passageway between said first portion and said fan chamber, said filter is releasably secured to said second portion to form a part of said clipping trap and is removable therewith from said housing;

said second portion is configured to be slidably removable from said housing in a direction generally perpendicular to said first portion from an operational position in which said filter is generally axially displaced from said fan chamber inlet.

2. The hair clipping device of claim 1 wherein said filter has an area being substantially larger than said inlet.

3. The hair clipping device of claim 1 wherein said fain has a diameter determined by the size of the fan chamber, and is configured, based on said diameter, to optimize water lift and air flow values.

4. The hair clipping device of claim 3 wherein said diameter is approximately 1½ inches, said fan rotates at approximately 7,000 RPM and said fan is configured to move at least approximately 6 CFM of air flow and 0.7 inches of water lift.

5. The hair clipping device of claim 3 wherein said fan has a generally circular base and a plurality of arcuate blades secured thereto, said blades each having a rear edge reaching an outer diameter of said base.

6. The hair clipping device of claim 5 wherein said blades each have a pointed tip opposite said rear edge.

7. The hair clipping device of claim 5 wherein there are five of said blades secured to said base.

8. The hair clipping device of claim 1 wherein said clipping trap defined by said second portion is in the form of an open tray or box, with said removable filter being disposed to form a wall of said box.

9. The hair clipping device of claim 1 further including a battery compartment in said housing being generally axially displaced from said fan chamber, said second portion being disposed between said battery compartment and said fan chamber.

10. A hair clipping device, comprising:

a housing defining a vacuum intake, a fan chamber and a vacuum passageway defining fluid communication between said vacuum intake and said fan chamber, and defining a cutting location;

a fan disposed in said fan chamber;

a bladeset mounted to said housing and having at least one stationary blade and at least one moving blade for clipping hair with a reciprocating action, said bladeset defining at least one pair of opposing cutting edges;

said vacuum passageway including a second portion extending generally perpendicular to a first portion, a second portion being removable from said housing and configured as a clipping trap for retaining collected clippings upon removal of said second portion from said housing;

a blade chassis rotatably mounted to said housing at least between a first position and a second position and configured to provide a mounting point for said bladeset so that said at least one pair of said cutting edges are disposed at said cutting location in operational proximity to said intake; and said blade chassis being provided with at least one deflector formation configured for deflecting hair clippings into said vacuum intake regardless of whether said chassis is in said first position or said second position;

said cutting location is disposed in operational relation to said vacuum intake so that hair clippings are drawn into said intake for collection into said clipping trap within said housing regardless of whether said blade chassis is in said first position or said second position;

a locking mechanism configured for releasably securing said blade chassis in a selected one of said first position and said second position;

a comb assembly configured for releasable attachment to said housing; and said locking mechanism includes a locking member biased toward a closed position and having a first lug for engaging said blade chassis, a second lug for engaging said comb assembly, and an actuator for releasing said lugs from biasing engagement.

11. The hair clipping device of claim 10 wherein said bladeset is configured so that said pair of opposed cutting edges include a narrow cutting edge and a wide cutting edge opposite said narrow cutting edge.

12. The hair clipping device of claim 11 wherein said bladeset is configured so that said narrow cutting edge extends farther over said vacuum intake than said wide cutting edge.

13. A hair clipping device, comprising:

a housing defining a vacuum intake, a fan chamber and a vacuum passageway defining fluid communication between said vacuum intake and said fan chamber;

a fan rotatably disposed in said fan chamber and having an axis of rotation, said fan chamber having an inlet;

said vacuum passageway having a first portion being generally parallel to said axis of rotation and configured so that air is drawn into said inlet in a first direction; and enters said fan chamber in a substantially opposite direction;

said vacuum passageway including a second portion extending generally perpendicular to said first portion, a battery compartment in said housing being generally axially displaced from said fan chamber, said second portion being disposed between said battery compartment and said fan chamber; and said entire second portion is slidably removable from said housing in a direction substantially perpendicular to said first portion from an operational position in which a filter is generally axially displaced from said fan chamber inlet, in said operational position said second portion being located between said battery chamber and said fan inlet so that said filter is adjacent said fan inlet.

14. A hair clipping device, comprising:

a housing defining a vacuum intake, a fan chamber and a vacuum passageway defining fluid communication between said vacuum intake and said fan chamber, and defining a cutting location;

a fan disposed in said fan chamber;

a bladeset mounted to said housing and having at least one stationary blade and at least one moving blade for clipping hair with a reciprocating action, said bladeset defining at least one pair of opposing cutting edges;

a blade chassis rotatably mounted to said housing at least between a first position and a second position and configured to provide a mounting point for said bladeset so that said at least one pair of said cutting edges are disposed at said cutting location in operational proximity to said intake;

said blade chassis being provided with at least one deflector formation configured for deflecting hair clippings into said vacuum intake regardless of whether said chassis is in said first position or said second position;

a locking mechanism configured for releasably securing and said blade chassis in a selected one of said first position and said second position;

a comb assembly configured for releasable attachment to said housing;

wherein said locking mechanism includes a locking member biased toward a closed position and having a first lug for engaging said blade chassis, a second lug for engaging said comb assembly, and an actuator for releasing said lugs from biasing engagement.

* * * * *

UNITED STATES PATENT AND TRADEMARK OFFICE

CERTIFICATE OF CORRECTION

PATENT NO. : 6,739,053 B2
DATED : May 25, 2004
INVENTOR(S) : McCambridge et al.

It is certified that error appears in the above-identified patent and that said Letters Patent is hereby corrected as shown below:

Title page,
Item [57], ABSTRACT,
Replace the abstract with the following:

--A hair clipping device including a housing defining a vacuum intake, a fan chamber and a vacuum passageway defining fluid communication between the vacuum intake and the fan chamber. A fan is rotatably disposed in the fan chamber and has an axis of rotation. The vacuum passageway has a first portion being generally parallel to the axis of rotation and is configured so that air is drawn into the intake in a first direction, and enters the fan chamber in a substantially opposite direction, and the vacuum passageway includes a second portion extending generally perpendicular to the first portion, the second portion being removable from the housing and configured as a clipping trap. The vacuum intake has at least one formation for deflecting clippings into the intake. A blade chassis is rotatably mounted to the housing to provide multiple cutting edges relative to a cutting location which is in operational proximity to the intake.--

Column 1,
Line 23, delete "Clippings on one's clothing are especially unsightly."
Line 34, replace with the following:

--Another attempt to address the problem of collecting hair trimmings is commonly-assigned U.S. Patent No. 5,075,971, which discloses a cordless trimmer for delicate hairs such as those growing in or around the nose, ears and/or eyes. Since this device is designed for precise cutting of delicate areas, it does not efficiently address the needs of individuals with larger moustaches, beards and/or sideburns, who require the ability to quickly and evenly trim their facial hair. An increase in power will generate additional clippings, and as such a more effective vacuum system is needed.--

UNITED STATES PATENT AND TRADEMARK OFFICE

CERTIFICATE OF CORRECTION

PATENT NO. : 6,739,053 B2
DATED : May 25, 2004
INVENTOR(S) : McCambridge et al.

It is certified that error appears in the above-identified patent and that said Letters Patent is hereby corrected as shown below:

Column 1, (cont)

Line 44, replace paragraph with the following:

--Another concern of individuals with facial hair is the ability to precisely trim around the nose, lips and ears with the same device as is used for performing the "gross" trimming. In response, some conventional electric clippers or shavers offer pop-up trimming blades which are supplemental to the main cutting blades. However, these supplemental trimming blades are more difficult to use accurately in providing an even cut to facial hair. In some versions, the trimming blades are too close to the main blades, causing the user to make inadvertent cuts with the main blades while using the trimmer. Further, the close proximity of the main and trimmer blades in some cases obscures the area to be trimmed.--

Line 58, replace paragraph with the following:

--An important design factor for creating a hair clipper with a vacuum system is the need to create a sufficiently effective vacuum for collecting the hair clippings generated by the reciprocating blades, while operating under the constraint of a motor of the type typically used in such devices, operating in the range of 2,500 to 9,000 RPM. For comparison purposes, conventional vacuum appliances typically have motors operating in the range of 13,000 RPM. The vacuum required for a hair clipping device must create sufficient pressure and air flow to collect the clippings and move them toward a storage container.--

Line 62, replace paragraph with the following:

-- Another design factor for a hair clipping device with an internal vacuum system is that the fan and drive motor should be isolated from the flow of hair clippings so that the air flow passage, fan and drive motor will not become clogged.--

UNITED STATES PATENT AND TRADEMARK OFFICE

CERTIFICATE OF CORRECTION

PATENT NO. : 6,739,053 B2
DATED : May 25, 2004
INVENTOR(S) : McCambridge et al.

It is certified that error appears in the above-identified patent and that said Letters Patent is hereby corrected as shown below:

Column 2,

Line 1, replace paragraph with the following:

-- Accordingly, a first object of the present invention is to provide an improved hair clipping device with an internal vacuum for easily collecting hair.

Another object of the present invention is to provide an improved hair clipping device having an internal vacuum and which is configured for collecting and easily removing hair clippings generated from the clipping operation.--

Line 6, replace paragraph with the following:

-- A further object of the present invention is to provide an improved hair clipping device having an internal vacuum and which is configured for isolating the clipper drive and the vacuum generation mechanisms from the flow of collected hair clippings.--

Line 11, replace paragraph with the following:

-- Yet another object of the present invention is to provide an improved hair clipping device having a vacuum feature for collecting hair clippings, and which also features a comb assembly for use in trimming a range of hair lengths, wherein the comb assembly assists in deflecting hair clippings into the vacuum system.--

Line 18, replace paragraph with the following:

--Still another object of the present invention is to provide an improved hair clipping device having an internal vacuum system as well as at least two types of blade edges, wherein any selected blade edge is positionable in operational relationship to the vacuum system so that hair clippings generated in the clipping process are collected by the vacuum system.--

UNITED STATES PATENT AND TRADEMARK OFFICE

CERTIFICATE OF CORRECTION

PATENT NO. : 6,739,053 B2
DATED : May 25, 2004
INVENTOR(S) : McCambridge et al.

It is certified that error appears in the above-identified patent and that said Letters Patent is hereby corrected as shown below:

Column 2, (cont)

Line 26, replace paragraph under the title heading "BRIEF SUMMARY OF THE INVENTION", with the following paragraph:

--The above-listed objects are met or exceeded by the present hair clipping device with internal vacuum which features a removable hair clipping collection device which is a portion of the internal vacuum passageway. Also, the internal vacuum system is powered by the same motor which powers the clipper blades. A replaceable filter protects the motor from becoming clogged with clippings. A specially designed fan creates sufficient vacuum to collect and move hair clippings toward the receptacle. A removable comb assembly facilitates clipping longer length hair, and also deflects clippings into a vacuum intake. Multiple types of cutting blade edges are provided on a pivotable chassis which is driven by a single drive member. Whichever blade edge is selected is disposed close enough to the vacuum intake so that clippings are collected. The selected size blade is releasably locked in place, and the comb assembly is also secured to a clipper housing.--

Line 50, replace paragraph with the following:

--More specifically, the present invention provides a hair clipping device including a housing defining a vacuum intake, a fan chamber and a vacuum passageway defining fluid communication between the vacuum intake and the fan chamber. A fan is rotatably disposed in the fan chamber and has an axis of rotation. The vacuum passageway has a first portion being generally parallel to the axis of rotation and is configured so that air is drawn into the intake in a first direction, and enters the fan chamber in a substantially opposite direction, and the vacuum passageway includes a second portion extending generally perpendicular to the first portion, the second portion being removable from the housing and configured as a clipping trap.--

UNITED STATES PATENT AND TRADEMARK OFFICE

CERTIFICATE OF CORRECTION

PATENT NO. : 6,739,053 B2
DATED : May 25, 2004
INVENTOR(S) : McCambridge et al.

It is certified that error appears in the above-identified patent and that said Letters Patent is hereby corrected as shown below:

Column 2, (cont)
Line 64, replace paragraph with the following:

--In another embodiment, the invention provides a hair clipping device, including a housing defining a vacuum intake, a fan chamber and a vacuum passageway defining fluid communication between the vacuum intake and the fan chamber. A fan is rotatably disposed in the fan chamber for creating a vacuum in the vacuum passageway. A bladeset is disposed on the housing in operational relationship to the vacuum intake so that hair clippings generated by reciprocating cutting action of the bladeset are drawn by the vacuum into the passageway through the intake, and the intake has at least one formation for deflecting clippings into the intake.--

Column 3,
Line 9, replace paragraph with the following:

--In yet another embodiment, the invention provides a hair clipping device, including a housing defining a vacuum intake, a fan chamber, a cutting location and a vacuum passageway defining fluid communication between the vacuum intake and the fan chamber. A fan is rotatably disposed in the fan chamber. A bladeset is mounted to the housing and has at least one stationary blade and at least one moving blade for clipping hair with a reciprocating action, the bladeset defining at least one pair of opposing cutting edges. A blade chassis is rotatably mounted to the housing at least between a first position and a second position and configured to provide a mounting point for the bladeset so that the at least one pair of the cutting edges are disposed at the cutting location in operational proximity to the intake.--

Column 5,
Line 26, replace "blade 76" with -- blade 28 --.

Column 8,
Line 7, replace "6,079,013" with -- 6,079,103 --.

Column 12,
Line 35, replace "hair clipping device with rotating bladeset having multiple cutting edges" with -- hair clipping device with internal vacuum and rotating bladeset --.

UNITED STATES PATENT AND TRADEMARK OFFICE

CERTIFICATE OF CORRECTION

PATENT NO. : 6,739,053 B2
DATED : May 25, 2004
INVENTOR(S) : McCambridge et al.

It is certified that error appears in the above-identified patent and that said Letters Patent is hereby corrected as shown below:

Column 13,
Line 5, replace "fain" with -- fan --.

Signed and Sealed this

Fifteenth Day of March, 2005

JON W. DUDAS
*Director of the United States Patent and Trademark Office*